US008398209B2

(12) United States Patent
Tai et al.

(10) Patent No.: US 8,398,209 B2
(45) Date of Patent: Mar. 19, 2013

(54) INTEGRATED STRUCTURE OF A PRINTER HEAD AND AN ANTENNA

(75) Inventors: Feng-Yi Tai, Chung-Ho (TW); Ta-Cheng Hsiung, Hsinchu (TW)

(73) Assignee: Godex International Co., Ltd., New Taipei (TW)

( * ) Notice: Subject to any disclaimer, the term of this patent is extended or adjusted under 35 U.S.C. 154(b) by 748 days.

(21) Appl. No.: 12/617,699

(22) Filed: Nov. 12, 2009

(65) Prior Publication Data

US 2011/0109671 A1 May 12, 2011

(51) Int. Cl.
*B41J 2/14* (2006.01)
*B41J 2/16* (2006.01)

(52) U.S. Cl. ..... 347/50; 347/58

(58) Field of Classification Search ..... 347/2, 20, 347/49, 50, 56–59
See application file for complete search history.

(56) References Cited

U.S. PATENT DOCUMENTS 4,963,886 A * 10/1990 Fukuda et al. ..... 347/209
5,739,836 A * 4/1998 Nishi ..... 347/200
2009/0206995 A1 * 8/2009 Forster ..... 340/10.1

* cited by examiner

*Primary Examiner* — Juanita D Jackson

(57) ABSTRACT

An integrated structure of an inkjet head and an antenna includes a metal heat dissipation board, a flexible (or rigid) circuit board and an antenna module. The metal heat dissipation has an elongated printing ribbon. The flexible (or rigid) circuit board is mounted on the metal heat dissipation board, and has one end electrically connected with the printing ribbon and the other end having a plurality of parallel circuits mounted thereon and connected to external control circuits. The antenna module is directly mounted on and electrically connected with the flexible (or rigid) circuit board. Given the integrated structure, the antenna module is effectively mounted on the inkjet head to reduce the size of the structure and lower the cost thereof.

6 Claims, 2 Drawing Sheets

INTEGRATED STRUCTURE OF A PRINTER HEAD AND AN ANTENNA

FIELD OF THE INVENTION

The present invention is related to an integrated structure of printer head and an antenna, and more particularly to a printer head integrated with an RFID reader/writer, thereby lowering cost thereof and optimizing position of an antenna module to accurately read.

BACKGROUND OF THE INVENTION

RFID (Radio Frequency Identification) is a communication technique capable of identifying a specific target and reading/writing related data through radio signals without establishing either mechanical or optical contact. When an RFID system is operated, an identification chip inside a RFID tag is driven by received electromagnetic signals from an RFID reader. When the RFID tag receives enough signals, it transmits data to the RFID reader. These data contain not only ID number but also data previously stored in an EEPROM inside the RFID tag.

To keep abreast with technological advancement and market demand, current RFID technology hasn't run its full course and can be integrated with the techniques associated with database management systems, computer networks, firewalls and so forth to provide the functions of fully automatic, safe and convenient real-time surveillance systems. RFID applications, such as, banknote antifalsification, ID card, electronic toll collection system, material flow management, airline baggage tracking, production automation control, warehousing management, transportation monitoring, security management, medical management, and the like, have been extensively adopted.

If intending to additionally mount a RFID system to a conventional barcode printer, an antenna module must be added in the proximity of an inkjet head of the printer so as to read/write RFID tags while printing. However, conventional antenna modules are usually not well-planned. Most of the conventional antenna modules are mounted to form an independent circuit board. While being assembled, the circuit board containing the conventional antenna module is mounted to a chosen position abutting the inkjet head. Therefore, it becomes inevitable that the circuit board has to be further washed and soldered with components and reserved spaces inside various printers have to be rearranged. All these end up with more production and assembly time and higher cost.

In view of the RFID system of conventional barcode printers not properly integrated, inventor further focuses on these shortcomings to develop and brings forth the present invention at last.

SUMMARY OF THE INVENTION

The main objective is to provide an integrated structure of a printer head and an antenna. The integrated structure includes a metal heat dissipation board, a flexible (or rigid) circuit board and an antenna module.

The metal heat dissipation board has an elongated printing ribbon. The flexible (or rigid) circuit board is mounted on the metal heat dissipation board, and has one end electrically connected with the printing ribbon and the other end having a plurality of parallel circuits mounted thereon and adapted to connect to external control circuits. The antenna module is directly mounted on and electrically connected with the flexible (or rigid) circuit board. Given the integrated structure, the antenna module is effectively mounted on the printer head to reduce the size of the structure and lower the cost thereof.

The foregoing and other features and advantages of the present invention will be more clearly understood through the following descriptions with reference to the drawing, wherein:

DETAILED DESCRIPTION OF THE PREFERRED EMBODIMENT

The present invention will now be described more specifically with reference to the following embodiments. It is to be noted that the following descriptions of preferred embodiments of this invention are presented herein for the purpose of illustration and description only; it is not intended to be exhaustive or to be limited to the precise form disclosed.

Figure 1:
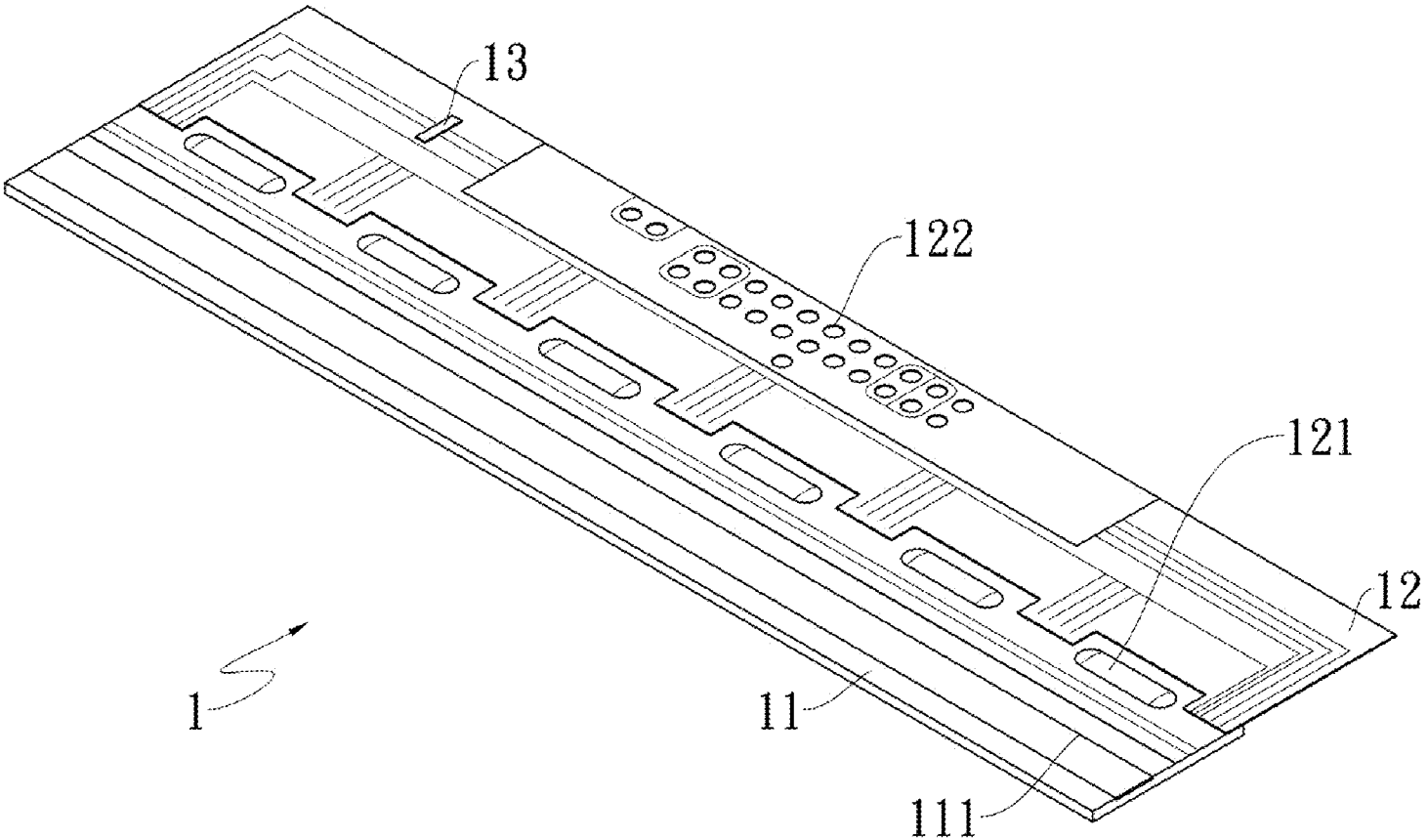
FIG. 1 is a perspective view of the present invention.
Figure 2:
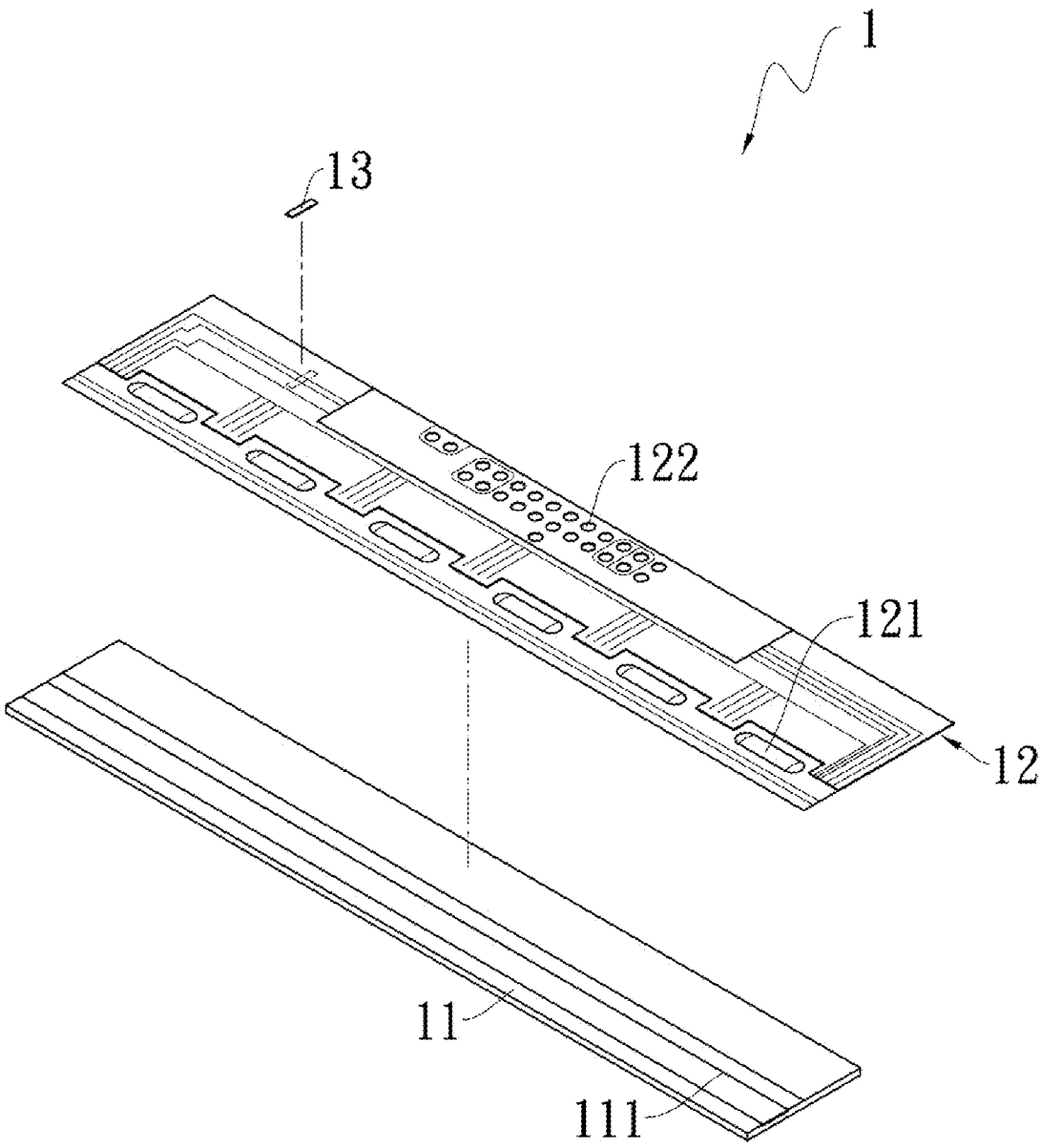
FIG. 2 is an exploded perspective view of the present invention.

With reference to FIGS. 1 and 2, an integrated structure of a printer head and antenna whose reference numeral is marked by (1), has a metal heat dissipation board (11), a flexible (or rigid) printed circuit board (PCB) (12) and an antenna module (13). The metal heat dissipation board (11) has an elongated printing ribbon (111) mounted thereon to output a preset data through the printing ribbon (111).

The flexible (or rigid) PCB (12) is mounted on the metal heat dissipation board (11), and has a plurality of driving ICs (121) mounted on one end thereof and electrically connected with the printing ribbon (111) to perform hot-print operation. A plurality of pin outs 122 of parallel circuits are mounted on the other end of the flexible (or rigid) PCB (12) to respectively correspond to the plurality of driving ICs (121) and serve to connect with external control circuits (not shown).

The antenna module (13) is an RFID tag reading antenna transmitting and receiving data through transmitted radio frequency waves, and serving to transmit and receive RF signals between a RFID tag and a reader (not shown). To implement, the antenna module (13) may be a chip or a circuit board, and is electrically connected with the flexible (or rigid) PCB (12) directly so as to output a data signal. With reference to FIG. 2, while assembling, special attention shall be paid to a position at which the antenna module (13) is mounted such that the antenna module (13) stays away from the metal heat dissipation board (11) to prevent metal obstruction arising therefrom and ensures to maintain normal operation.

Owing to the effective design of the present invention, the antenna module (13) is electrically connected with the flexible (or rigid) PCB (12) directly to become a part of the printer head (1). Consequently, the production of the integrated structure of the present invention can be simplified without requiring to further wash PCB and solder components thereon. Moreover, regardless of what type of printer is in use and how the reserved space inside printer is arranged, a simple layout can be configured and universally applied to all types of printer at no cost of further modification. The production and assembly are easily achieved, thereby effectively reducing production costs, freeing the space occupied by the conventional RFID antenna module, and doubling efficacy with a single device.

As the antenna module (13) is integrated as a part of the printer head (1) in operation, the antenna module (13) can be directly positioned to the most sensitive location of the RFID tag, ensuring to more accurately read data of the RFID tag.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims, which are to be accorded with the broadest interpretation so as to encompass all such modifications and similar structures.

What is claimed is:

1. An integrated structure of an printer head and an antenna, comprising:

a metal heat dissipation board having an elongated printing ribbon;

a circuit board mounted on the metal heat dissipation board and being a flexible circuit board or a rigid flexible circuit board, one end thereof electrically connected with the printing ribbon and the other end having a plurality of parallel pin out circuits to be connected externally; and an antenna module electrically connected with and directly mounted on the circuit board so as to be mounted on the printer head.

2. The integrated structure of a printer head and an antenna as claimed in claim 1, wherein the circuit board has a plurality of driving ICs mounted on one end thereof and the plurality of pin outs respectively correspond to the plurality of driving ICs.

3. The integrated structure of a printer head and an antenna as claimed in claim 2, wherein the metal heat dissipation board abuts a position where the antenna module is mounted on the circuit board so that no metal obstruction is caused by the metal heat dissipation board.

4. The integrated structure of a printer head and an antenna as claimed in claim 3, wherein the antenna module is a Radio Frequency Identification (RFID) tag reading antenna.

5. The integrated structure of a printer head and an antenna as claimed in claim 4, wherein the antenna module is a chip.

6. The integrated structure of a printer head and an antenna as claimed in claim 4, wherein the antenna module is a circuit board.

* * * * *